US010065061B2

(12) United States Patent
Chen

(10) Patent No.: US 10,065,061 B2
(45) Date of Patent: Sep. 4, 2018

(54) EXERCISE BIKE WITH AN ADJUSTABLE INTERNAL GEAR DEVICE

(71) Applicant: Ya-Chi Chen, New Taipei (TW)

(72) Inventor: Ya-Chi Chen, New Taipei (TW)

( * ) Notice: Subject to any disclaimer, the term of this patent is extended or adjusted under 35 U.S.C. 154(b) by 0 days.

(21) Appl. No.: 15/258,185

(22) Filed: Sep. 7, 2016

(65) Prior Publication Data

US 2018/0064982 A1 Mar. 8, 2018

(51) Int. Cl.

| | |
|---|---|
| ***A63B 22/06*** | (2006.01) |
| ***A63B 21/00*** | (2006.01) |
| ***A63B 21/22*** | (2006.01) |
| ***A63B 21/015*** | (2006.01) |

(52) U.S. Cl.

CPC .. *A63B 21/00069* (2013.01); *A63B 21/00076* (2013.01); *A63B 21/015* (2013.01); *A63B 21/225* (2013.01); *A63B 22/0605* (2013.01)

(58) Field of Classification Search

CPC ..... A63B 21/00069; A63B 21/00076; A63B 21/015; A63B 21/225; A63B 22/0605

See application file for complete search history.

(56) References Cited

U.S. PATENT DOCUMENTS

| | | | | |
|---|---|---|---|---|
| 6,964,633 | B2 * | 11/2005 | Kolda | A63B 21/0051 482/63 |
| 7,901,334 | B2 * | 3/2011 | Chen | A63B 21/00069 482/63 |
| 9,839,810 | B1 * | 12/2017 | Tzeng | A63B 24/0087 |
| 2015/0080190 | A1 * | 3/2015 | Kaan | A63B 69/16 482/57 |
| 2016/0263416 | A1 * | 9/2016 | Golesh | A63B 21/0051 |

* cited by examiner

*Primary Examiner* — Loan H Thanh
*Assistant Examiner* — Megan Anderson
(74) *Attorney, Agent, or Firm* — Egbert Law Offices, PLLC

(57) ABSTRACT

An exercise bike includes a main frame having a seat extending therefrom. A peddle assembly is mounted on the main frame. A rotating damping element is rotatably mounted on the main frame by a second axle. A drive assembly is connected to the peddle assembly and the second axle. An internal gear device is disposed on the rotating damping element and includes a casing, an internal transmission is centrally received in the casing for driving the casing and a drive element connected to the internal transmission for operating the internal transmission. The second axle centrally extends through the internal gear device and the internal transmission is securely sleeved on the second axle, wherein the rotating damping element is securely sleeved on the on the casing. The damping provided to the exercise bike A is adjusted when the drive element of the internal gear device is operated once.

4 Claims, 5 Drawing Sheets

EXERCISE BIKE WITH AN ADJUSTABLE INTERNAL GEAR DEVICE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to an exercise bike, and more particularly to an exercise bike with an adjustable internal gear device.

2. Description of Related Art Including Information Disclosed Under 37 CFR 1.97 and 37 CFR 1.98

There are various exercise devices in the market, such as an exercise bike, a stepper, a rowing machine, a treadmill and a tension machine. The structure of the exercise bike is in the field of the present.

A conventional exercise bike usually provides a damping device connected to a pedal assembly of the exercise bike for promoting the exercise effect when operating the pedal assembly. The damping device usually includes a flywheel coupled with a magnetic-control module or an impeller.

However, the conventional exercise bike has some problems according to the used experience and the problems need to be advantageously altered. For example, the conventional only has a damping device, but provides a fixed step ratio. As a result, the damping of the conventional exercise bike is bored due to the fixed step ratio.

Some manufacturers think that the conventional exercise bike shall have a step ratio when the rear derailleur of a conventional bicycle is provided to the conventional exercise bike. However, the rear derailleur of a conventional bicycle is unsuitable to an exercise device because the rear derailleur of a conventional bicycle is exposed and laterally mounted to a hub. The rear derailleur of a conventional bicycle may make a trouble to the appearance design when the rear derailleur of a conventional bicycle is provided to an exercise device. In addition, the rear derailleur of a conventional bicycle needs a great assembling space. It is hard to be assembled to an exercise device that has a limited assembling space.

The present invention has arisen to mitigate and/or obviate the disadvantages of the conventional exercise bike.

BRIEF SUMMARY OF THE INVENTION

The main objective of the present invention is to provide an improved exercise bike that has an adjustable internal gear device mounted thereon for providing various rotating ratio coupled with the rotating damping element.

To achieve the objective, the exercise bike in accordance with the present invention comprises a main frame including a middle frame having two opposite ends respectively connected to a transverse frame. A seat extends from the middle frame and a front frame connected to the middle frame. A pedal assembly is mounted on the middle frame of the main frame. The pedal assembly includes a first axle rotatably extending through the middle frame. A first pedal and a second pedal are respectively mounted to a corresponding one of two opposite ends of the first axle. A rotating damping element is rotatably mounted on the middle frame of the main frame by a second axle, wherein the second axle is rotatable relative to the middle frame the rotating damping element is separated from the pedal. An internal gear device is disposed on the rotating damping element. The internal gear device includes a casing, an internal transmission centrally received in the casing for driving the casing and a drive element connected to the internal transmission for operating the internal transmission. The second axle centrally extends through the internal gear device for supporting the internal gear device and the internal transmission is securely sleeved on the second axle, wherein a hub of the rotating damping element is securely sleeved on the on the casing. The damping provided to the exercise bike is adjusted when the drive element of the internal gear device is operated once. A drive assembly is connected to the first axle of the pedal assembly and the second axle of the rotating damping element. The drive assembly including a drive chain wheel, a chain wheel set, a driven chain wheel, a first endless chain and a second endless chain. The drive chain wheel is securely sleeved on the first axle of the pedal assembly and the driven chain wheel is securely sleeved on the second axle of the rotating damping element. The chain wheel set is rotatably mounted on the main frame by a third axle between the first axle of the pedal assembly and the second axle of the rotating damping element. The chain wheel set includes a first chain wheel and a second chain wheel, wherein the first chain wheel has a diameter greater than that of the second chain wheel. The first chain wheel and the second chain wheel are simultaneously rotated with each other. The first endless chain coils the drive chain wheel and the second chain wheel of the chain wheel set, and the second endless chain coils the first chain wheel of the chain wheel set and the driven chain wheel.

Further benefits and advantages of the present invention will become apparent after a careful reading of the detailed description with appropriate reference to the accompanying drawings.

DETAILED DESCRIPTION OF THE INVENTION

Figure 1:
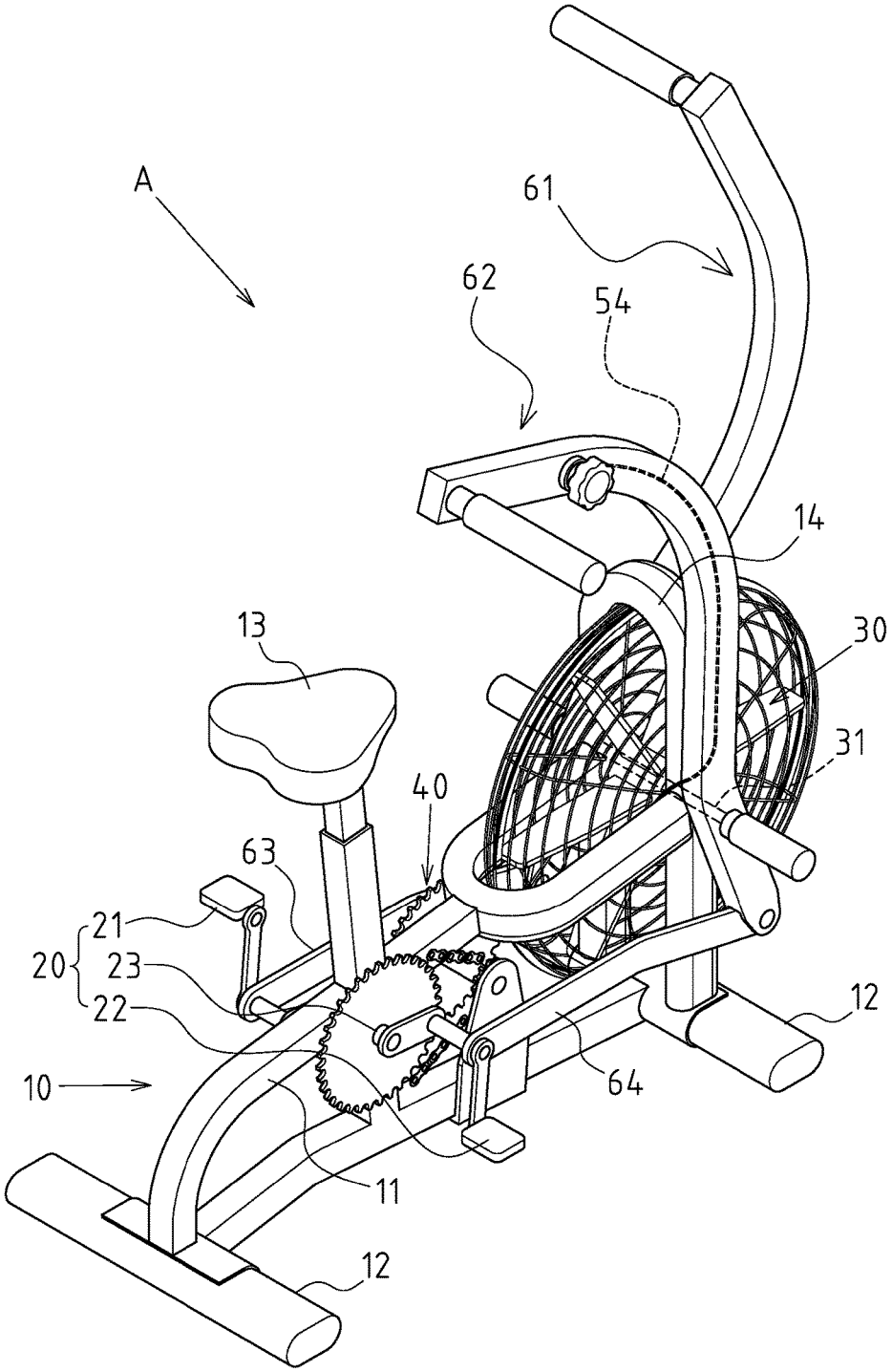
FIG. 1 is a perspective view of an exercise bike with an internal gear device in accordance with the present invention.
Figure 2:
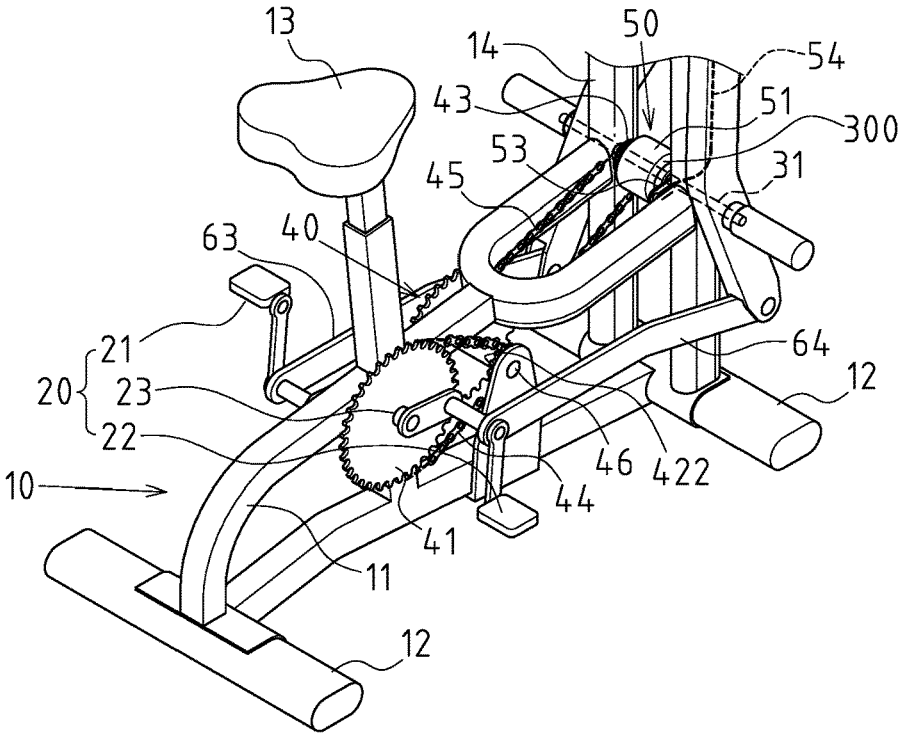
FIG. 2 is a partially perspective view of an exercise bike with an internal gear device with a dampening gear removed in accordance with the present invention.
Figure 3:
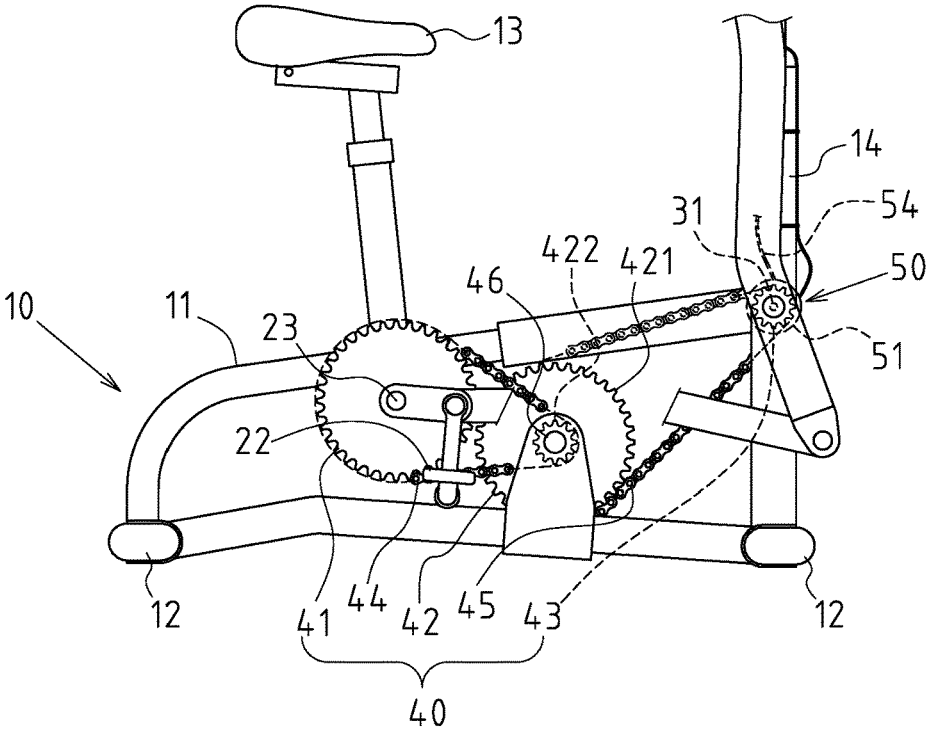
FIG. 3 is a partially side plan view of the exercise bike in FIG. 1.
Figure 4:
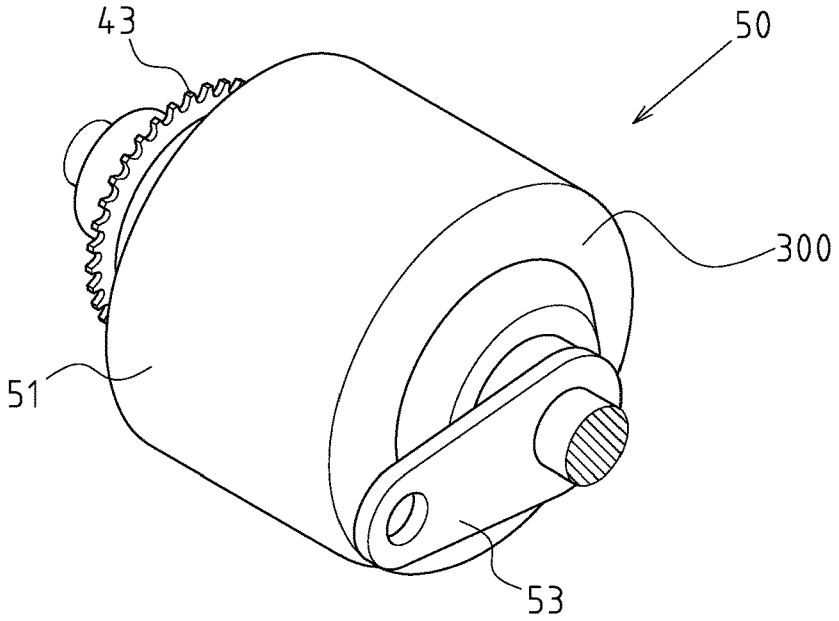
FIG. 4 is a perspective view of an internal gear device of the exercise bike in accordance with the present invention.
Figure 5:
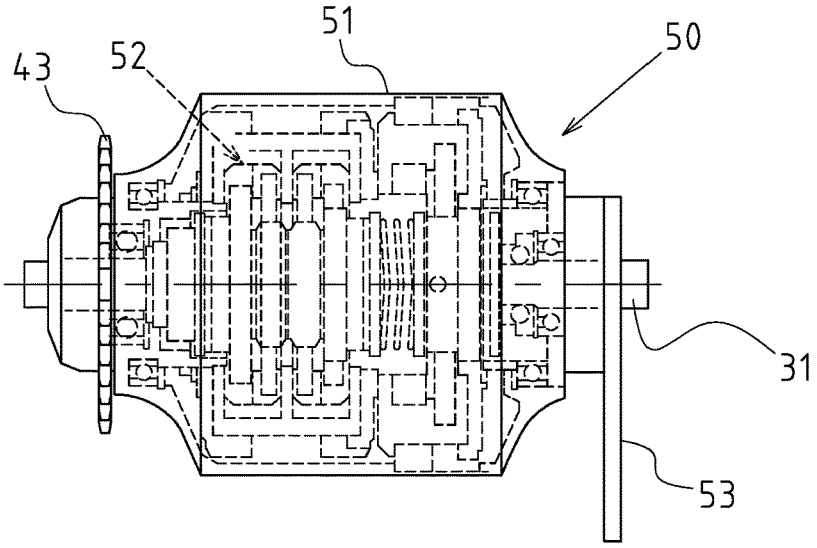
FIG. 5 is a rear plan view of the internal gear device in FIG. 4.

Referring to the drawings and initially to FIGS. 1-5, an exercise bike A with an internal gear device in accordance with the present invention comprises a main frame 10 including a middle frame 11 having two opposite ends respectively connected to a transverse frame 12. A seat 13 extends from the middle frame 11 and a front frame 14 connected to the middle frame 11. A pedal assembly 20 is mounted on the middle frame 11 of the main frame 10. The pedal assembly 20 includes a first axle 23 rotatably extending through the middle frame 11. A first pedal 21 and a second pedal 22 are respectively mounted to a corresponding one of two opposite ends of the first axle 23. A rotating damping element 30 is rotatably mounted on the middle frame 11 of the main frame 10 by a second axle 31, wherein the second axle 31 is rotatable relative to the middle frame 11 and the rotating damping element 30 is separated from the pedal 20. A drive assembly 40 is connected to the first axle 23 of the pedal assembly 20 and the second axle 31 of the rotating damping element 30. An internal gear device 50 is disposed on the rotating damping element 30. The internal gear device 50 includes a casing 51, an internal transmission 52 is centrally received in the casing 51 for driving the casing 51 and a drive element 53 connected to the internal transmission 52 for operating the internal transmission 52. In the preferred embodiment of the present invention, the second axle 31 centrally extends through the internal gear device 50 for supporting the internal gear device 50 and the internal transmission 52 is securely sleeved on the second axle 31, wherein a hub 300 of the rotating damping element 30 is securely sleeved on the on the casing 51 and the second axle 31 is coupled with the internal transmission 52. The damping provided to the exercise bike A is adjusted when the drive element 53 of the internal gear device 50 is operated once.

The rotating damping element 30 is selected from a group consisted of counterweight wheel, impeller and a magnetic-control wheel. In the preferred embodiment of the present invention, as shown in FIG. 1, the rotating damping element 30 is impeller.

The drive element 53 is operated by an element selected from a group consisted of a cable, a chain, a wrench, a linkage and an electric controller. In the preferred embodiment of the present invention, the drive element 53 is pulled by a cable 54 that is adapted to be connected to an adjust knob.

The drive assembly 40 includes a drive chain wheel 41, a chain wheel set 42, a driven chain wheel 43, a first endless chain 44 and a second endless chain 45. The drive chain wheel 41 is securely sleeved on the first axle 23 of the pedal assembly 20 and the driven chain wheel 43 is securely sleeved on the second axle 31 of the rotating damping element 30. The chain wheel set 42 is rotatably mounted on the main frame 10 by a third axle 46 between the first axle 23 of the pedal assembly 20 and the second axle 31 of the rotating damping element 30. The chain wheel set 42 includes a first chain wheel 421 and a second chain wheel 422, wherein the first chain wheel 421 has a diameter greater than that of the second chain wheel 422. The first chain wheel 421 and the second chain wheel 422 are simultaneously rotated with each other. The first endless chain 44 coils the drive chain wheel 41 and the second chain wheel 422 of the chain wheel set 42, and the second endless chain 45 coils the first chain wheel 421 of the chain wheel set 42 and the driven chain wheel 43.

In the preferred embodiment, the driven chain wheel 43 drives the second axle 31 and the internal transmission 52 to rotating the casing 51 with the rotating damping element 30 such that the internal gear device 50 provides a damping between the driven chain wheel 43 and the rotating damping element 30 of the exercise bike A due to a rotating ratio between the internal transmission 52 and the casing 51. The rotating ratio between the internal transmission 52 and the casing 51 is adjusted when operating the drive element 53 one. Accordingly, the total damping provided to the exercise bike A is adjusted.

With reference to FIG. 1, a first handle set 61 and a second handle set 62 are respectively pivotally mounted to two opposite sides of the front frame 14. A first linkage 63 is provided to pivotally connect to a lower end of the first handle set 61 and the first pedal 21, and a second linkage 64 is provided to pivotally connect to a lower end of the second handle set 62 and the second pedal 22. As a result, upper ends of the first handle set 61 and the second handle set 62 are alternately moved for providing an exercise effect to two arms of an operator when the first pedal 21 and the second pedal 22 are alternately operated.

Figure 6:
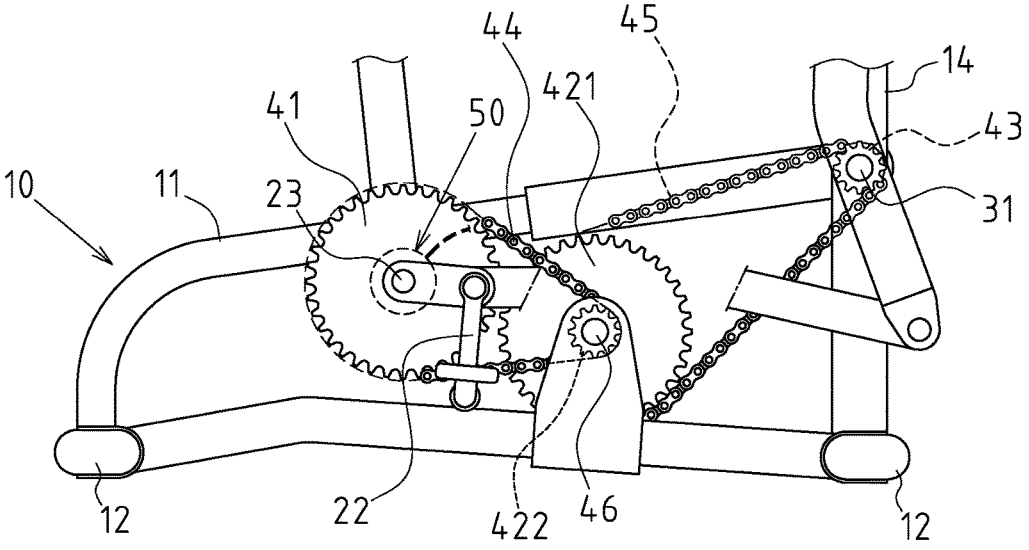
FIG. 6 is a side plan view of a second preferred embodiment of the exercise bike in accordance with the present invention, wherein the internal gear device is coupled with a drive chain wheel of the present invention.
Figure 7:
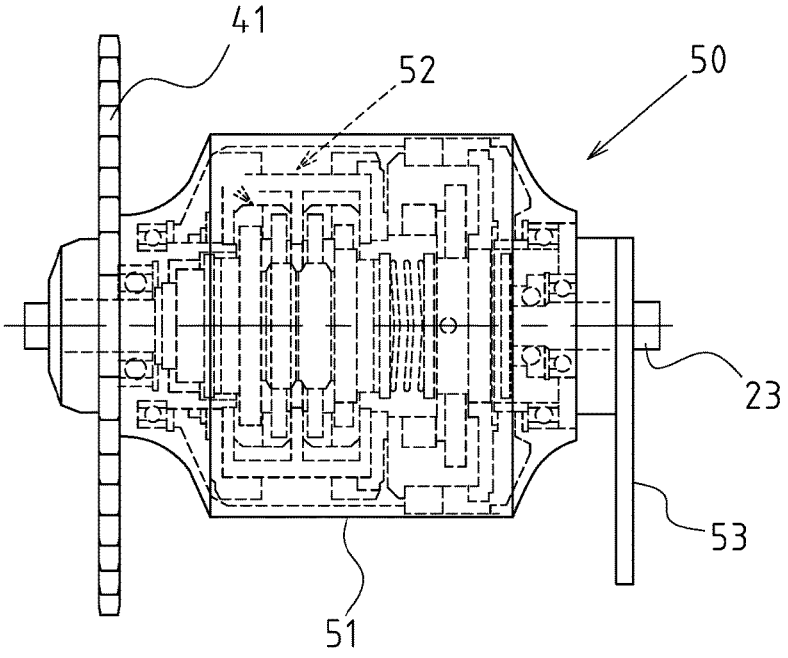
FIG. 7 is partial rear plane view of the internal gear device when being coupled with the drive chain wheel.

With reference to FIGS. 6 and 7 that show a second preferred embodiment of the exercise bike A in accordance with the present invention, in this embodiment, the internal gear device 50 is coupled with the drive chain wheel 41. Consequently, the rotating damping element 30 is operated by the driven chain wheel 43. The first chain wheel 421 and the second chain wheel 422 are simultaneously rotated with each other. The first axle 23 extends through the internal gear device 50 for supporting the internal gear device 50, wherein the internal transmission 52 is securely sleeved on the first axle 23 and the drive chain wheel 41 is co-axially and laterally secured to the casing 51 of the internal gear device 50, wherein the first axle 23 is rotatable relative to the drive chain wheel 41. The internal gear device 50 provides a damping between the third axle 46 and the drive chain wheel 41 of the exercise bike A due to a rotating ratio between the internal transmission 52 and the casing 51.

Figure 8:
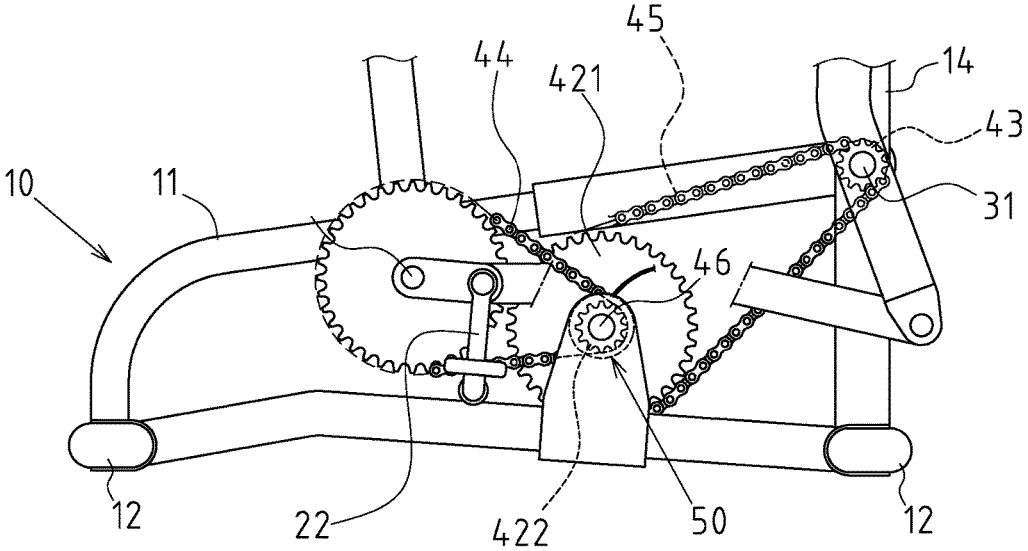
FIG. 8 is a side plan view of a second preferred embodiment of the exercise bike in accordance with the present invention, wherein the internal gear device is coupled with a chain wheel set of the present invention.
Figure 9:
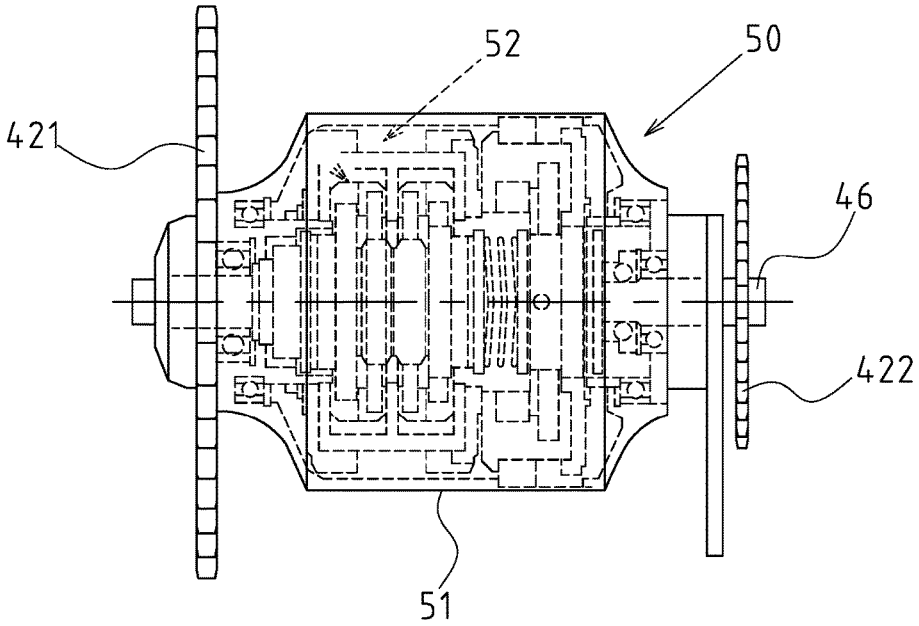
FIG. 9 is partial rear plane view of the internal gear device when being coupled with the chain wheel set.

With reference to FIGS. 8 and 9 that show a third preferred embodiment of the exercise bike in accordance with the present invention, in this embodiment, the internal gear device 50 is coupled with the chain wheel set 42. Consequently, the rotating damping element 30 is operated by the driven chain wheel 43. The third axle 46 is rotatably relative to the main frame 10 and centrally extends through the internal gear device 50 for supporting the internal gear device 50 and is coupled with the internal transmission 52. In this embodiment, the second chain wheel 422 is securely sleeved on the third axle 46, the internal transmission 52 is securely on the third axle 46 and the first chain wheel 421 is laterally and co-axially secured to the casing 51 of the internal gear device 50, wherein the third axle 46 is rotatable relative to the first chain wheel 421. The internal gear device

50 provides a damping between first chain wheel 421 and the second chain wheel 422 of the chain wheel set 42 of the exercise bike A due to a rotating ratio between the internal transmission 52 and the casing 51.

The internal gear device 50, whatever supported by the second axle 31, the third axle 46 of the first axle 23, provides a damping to the exercise bike A due to a rotating ratio between the internal transmission 52 and the casing 51, and the rotating ratio between the internal transmission 52 and the casing 51 is adjusted when operating the drive element 53 one. Accordingly, the damping provided to the exercise bike A is adjusted for providing a preferred exercise load to the operator. Consequently, the operator can flexibly adjust the damping and the rotating ratio of the internal gear device 50 for providing a changeable damping to the exercise bike A and a changeable exercise load to the operator. In addition, the internal gear device 50 needs a receiving space equal to a space for receiving a hub of a bicycle such that the internal gear device 50 is ideal device for the exercise bile A that has a limited mounting space. Furthermore, the internal gear device 50 is helpful to provide an attractive appearance and a high quality to the exercise bike A.

Although the invention has been explained in relation to its preferred embodiment, it is to be understood that many other possible modifications and variations can be made without departing from the spirit and scope of the invention as hereinafter claimed.

I claim:

1. An exercise bike comprising:

a main frame including a middle frame having two opposite ends respectively connected to a transverse frame, a seat extending from the middle frame and a front frame connected to the middle frame;

a pedal assembly mounted on the middle frame of the main frame, the pedal assembly including a first axle rotatably extending through the middle frame, a first pedal and a second pedal respectively mounted to a corresponding one of two opposite ends of the first axle;

a rotating damping element rotatably mounted on the middle frame of the main frame by a second axle, wherein the second axle is rotatable relative to the middle frame, and the rotating damping element is separated from the pedal assembly;

an internal gear device disposed on the rotating damping element, the internal gear device including a casing, an internal transmission centrally received in the casing for driving the casing and a drive element connected to the internal transmission for operating the internal transmission, the second axle centrally extending through the internal gear device for supporting the internal gear device and the internal transmission securely sleeved on the second axle, wherein a hub of the rotating damping element is securely sleeved on the casing, the rotating damping element provided to the exercise bike is adjusted when the drive element of the internal gear device is operated each time; and a drive assembly connected to the first axle of the pedal assembly and the second axle of the rotating damping element, the drive assembly including a drive chain wheel, a chain wheel set, a driven chain wheel, a first endless chain and a second endless chain, the drive chain wheel securely sleeved on the first axle of the pedal assembly and the driven chain wheel securely sleeved on the second axle of the rotating damping element, the chain wheel set rotatably mounted on the main frame by a third axle between the first axle of the pedal assembly and the second axle of the rotating damping element, the chain wheel set including a first chain wheel and a second chain wheel, wherein the first chain wheel has a diameter greater than that of the second chain wheel, the first chain wheel and the second chain wheel simultaneously rotated with each other, the first endless chain connecting the drive chain wheel and the second chain wheel of the chain wheel set, and the second endless chain connecting the first chain wheel of the chain wheel set and the driven chain wheel.

2. The exercise bike of claim 1, wherein the rotating damping element is selected from a group consisted of a counterweight wheel, an impeller and a magnetic-control wheel.

3. The exercise bike of claim 2, wherein the drive element is operated by a cable.

4. The exercise bike of claim 3, further comprising:

a first handle set and a second handle set respectively pivotally mounted to two opposite sides of the front frame;

a first linkage provided to pivotally connect to a lower end of the first handle set and the first pedal; and a second linkage provided to pivotally connect to a lower end of the second handle set and the second pedal.

* * * * *